US008269587B2

(12) United States Patent
Inoue et al.

(10) Patent No.: US 8,269,587 B2
(45) Date of Patent: Sep. 18, 2012

(54) CONDUCTION COOLING SUPERCONDUCTING MAGNET DEVICE

(75) Inventors: Tatsuya Inoue, Chiyoda-ku (JP); Shoichi Yokoyama, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 127 days.

(21) Appl. No.: 12/955,234

(22) Filed: Nov. 29, 2010

(65) Prior Publication Data

US 2011/0291779 A1 Dec. 1, 2011

(30) Foreign Application Priority Data

May 25, 2010 (JP) ..... 2010-119067

(51) Int. Cl.
*H01F 6/00* (2006.01)
*H01F 1/00* (2006.01)
*H01F 5/00* (2006.01)

(52) U.S. Cl. ..... 335/216; 335/300; 505/892

(58) Field of Classification Search ..... 335/216, 335/300; 505/892
See application file for complete search history.

(56) References Cited

U.S. PATENT DOCUMENTS

| | | | | |
|---|---|---|---|---|
| 4,333,228 | A * | 6/1982 | Koch | 29/599 |
| 4,369,636 | A * | 1/1983 | Purcell et al. | 62/49.2 |
| 4,692,560 | A * | 9/1987 | Hotta et al. | 174/15.4 |
| 5,132,618 | A * | 7/1992 | Sugimoto | 324/318 |
| 5,410,286 | A * | 4/1995 | Herd et al. | 335/216 |
| 5,412,363 | A * | 5/1995 | Breneman et al. | 335/216 |
| 5,583,472 | A * | 12/1996 | Moritsu et al. | 335/216 |
| 5,936,499 | A * | 8/1999 | Eckels | 335/216 |
| 6,107,905 | A * | 8/2000 | Itoh et al. | 335/216 |
| 6,163,241 | A * | 12/2000 | Stupak et al. | 335/300 |
| 7,126,448 | B2 * | 10/2006 | Watanabe et al. | 335/216 |
| 7,170,377 | B2 * | 1/2007 | Jiang et al. | 335/216 |
| 7,509,815 | B2 * | 3/2009 | van Hasselt | 62/51.1 |
| 7,646,272 | B1 * | 1/2010 | Schmierer et al. | 335/216 |
| 7,705,701 | B2 * | 4/2010 | Huang et al. | 335/216 |
| 2007/0001792 | A1 * | 1/2007 | Nemoto et al. | 335/216 |
| 2009/0256663 | A1 * | 10/2009 | Hsieh et al. | 335/216 |

FOREIGN PATENT DOCUMENTS

| | | |
|---|---|---|
| JP | 4-370983 A | 12/1992 |
| JP | 11-340028 A | 12/1999 |
| JP | 2000-182821 A | 6/2000 |

* cited by examiner

*Primary Examiner* — Elvin G Enad
*Assistant Examiner* — Alexander Talpalatskiy
(74) *Attorney, Agent, or Firm* — Buchanan Ingersoll & Rooney PC

(57) ABSTRACT

A superconducting coil is accommodated in a vacuum chamber. A radiation shield is arranged in the vacuum chamber with a prescribed space from the vacuum chamber to surround a periphery of the superconducting coil. A refrigerator cools the superconducting coil and the radiation shield by conduction. A provided member at least partly lies between the vacuum chamber and the radiation shield, through which heat is conducted from the vacuum chamber to the radiation shield. A cooling pipe has opposite end portions drawn out of the vacuum chamber and an intermediate portion in contact with the superconducting coil, the radiation shield, and the provided member. The provided member dissipates heat into a coolant flowing through the cooling pipe, to reduce the heat conducted to the radiation shield.

8 Claims, 5 Drawing Sheets

CONDUCTION COOLING SUPERCONDUCTING MAGNET DEVICE

BACKGROUND OF THE INVENTION

1. Field of the Invention

The present invention relates to a conduction cooling superconducting magnet device.

2. Description of the Background Art

Japanese Patent Laying-Open No. 11-340028 and Japanese Patent Laying-Open No. 2000-182821 each disclose a conduction cooling superconducting magnet device including a pipe through which a coolant flows, in addition to a refrigerator, in order to reduce initial cooling time.

The superconducting magnet device described in Japanese Patent Laying-Open No. 11-340028 includes a cooling pipe having opposite end portions drawn out of a vacuum chamber and an intermediate portion in thermal contact with a superconducting coil. The cooling pipe includes a first shield-penetrating portion penetrating a radiation shield in a thermal non-contact state, and a second shield-penetrating portion penetrating the radiation shield in a thermal contact state.

The superconducting magnet device described in Japanese Patent Laying-Open No. 2000-182821 includes a coolant repository provided in a radiation shield, and a coolant supply pipe and a coolant discharge pipe in communication with a coolant supply system and a coolant discharge system provided outside a vacuum chamber, respectively. The coolant repository is thermally connected to a superconducting coil directly or via a thermal conduction member.

With a pipe through which a coolant flows being in contact with a superconducting coil as described above, the superconducting coil can be cooled in a short time by a refrigerator and the coolant flowing through the pipe.

A conduction cooling superconducting magnet device includes a provided member penetrating or being in contact with a radiation shield while penetrating or being in contact with a vacuum chamber in contact with the outside. Such provided member conducts external heat from the vacuum chamber to the radiation shield, and has thus been a factor preventing cooling inside the radiation shield.

SUMMARY OF THE INVENTION

An object of the present invention is to provide a conduction cooling superconducting magnet device capable of achieving reduced initial cooling time.

A conduction cooling superconducting magnet device according to the present invention includes a vacuum chamber, a superconducting coil, a radiation shield, a refrigerator, a provided member, and a cooling pipe. The superconducting coil is accommodated in the vacuum chamber. The radiation shield is arranged in the vacuum chamber with a prescribed space from the vacuum chamber to surround a periphery of the superconducting coil. The refrigerator cools the superconducting coil and the radiation shield by conduction. The provided member at least partly lies between the vacuum chamber and the radiation shield, through which heat is conducted from the vacuum chamber to the radiation shield. The cooling pipe has opposite end portions drawn out of the vacuum chamber and an intermediate portion in contact with the superconducting coil, the radiation shield, and the provided member. In the conduction cooling superconducting magnet device, the provided member dissipates heat into a coolant flowing through the cooling pipe, to reduce the heat conducted to the radiation shield.

According to the present invention, initial cooling time of a conduction cooling superconducting magnet device can be reduced.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
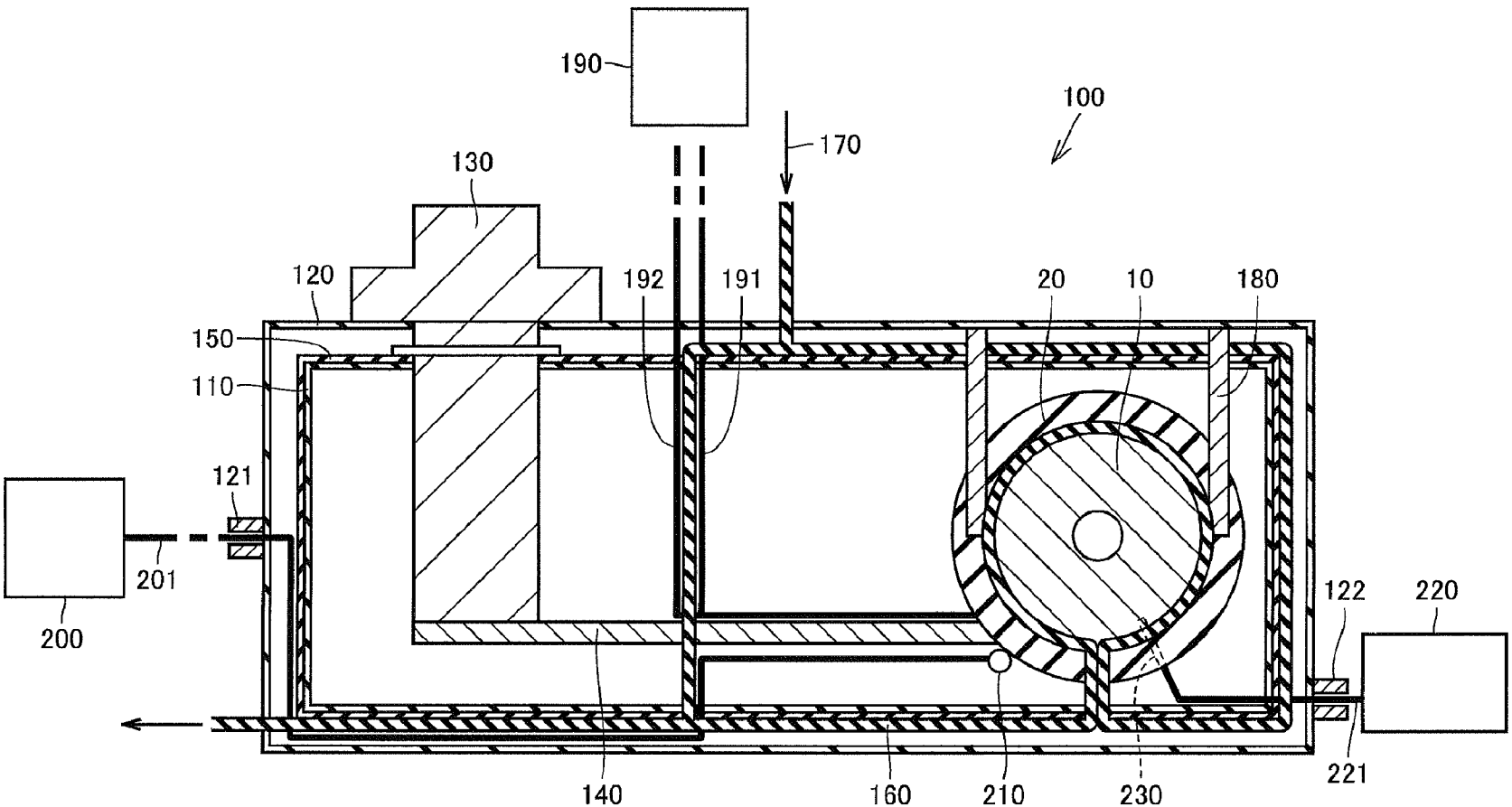
FIG. 1 is a cross-sectional view showing a structure of a conduction cooling superconducting magnet device according to a first embodiment of the present invention.

A conduction cooling superconducting magnet device according to a first embodiment of the present invention will be described hereinbelow with reference to the drawings. The same or corresponding parts have the same reference signs allotted in the drawings in the following description of embodiments, and description thereof will not be repeated.

First Embodiment

FIG. 1 is a cross-sectional view showing a structure of a conduction cooling superconducting magnet device according to a first embodiment of the present invention. As shown in FIG. 1, a conduction cooling superconducting magnet device 100 according to the first embodiment of the present invention includes a vacuum chamber 120 having an evacuated inside in order to suppress thermal conduction from outside.

Vacuum chamber 120 accommodates a superconducting coil 10 having a superconducting wire wound therearound. A coil winding frame 20 is wound and attached around superconducting coil 10. Superconducting coil 10 is suspended by a load support 180 having one end attached to an inner wall of vacuum chamber 120 and the other end connected to a side end portion of coil winding frame 20. Load support 180 is formed from a plate-like member made of GFRP (Glass Fiber Reinforced Plastics). In vacuum chamber 120, a radiation shield 110 is arranged with a prescribed space from vacuum chamber 120 to surround a periphery of superconducting coil 10. Radiation shield 110 is also connected to and supported by load support 180.

In order to suppress conduction of radiation heat from outside to superconducting coil 10, an SI (superinsulation) 150 serving as a heat insulating material having a multilayer structure is arranged on an outer surface of radiation shield 110 to cover radiation shield 110. In the present embodiment, a clearance is provided between the inner wall of vacuum chamber 120 and SI 150 to prevent direct contact between them.

A refrigerator 130 for cooling superconducting coil 10 and radiation shield 110 by conduction is arranged to penetrate vacuum chamber 120 and radiation shield 110. A GM (Gifford-McMahon) refrigerator is used as refrigerator 130. Refrigerator 130 includes a first stage and a second stage. The first stage of refrigerator 130 is in contact with radiation shield 110. The second stage of refrigerator 130 is connected to superconducting coil 10 via a thermal conduction member 140.

During normal operation after completion of initial cooling, superconducting coil 10 is maintained at a prescribed temperature (e.g., 4.2 K) by the two stages of refrigerator 130. Radiation shield 110 is maintained at a temperature higher than that of superconducting coil 10 (e.g. 80 K) by the first stage of refrigerator 130.

Superconducting coil 10 is connected to a power supply 190 arranged outside vacuum chamber 120 via leads 191, 192 drawn out of vacuum chamber 120. Lead 191 and lead 192 are formed by being covered with a conducting material having an electrical insulation property.

In the present embodiment, a thermometer 210 serving as a temperature measurement unit for determining a temperature in radiation shield 110 is arranged in the vicinity of superconducting coil 10 in radiation shield 110. Thermometer 210 is connected to an external display device 200 arranged outside vacuum chamber 120 for displaying a measurement result from thermometer 210 via a lead 201 drawn out of vacuum chamber 120. A connector 121 is provided in a position where lead 201 is drawn out of vacuum chamber 120.

In the present embodiment, a voltmeter 220 serving as a voltage measurement unit for detecting a voltage applied to superconducting coil 10 to check whether or not superconducting coil 10 has been quenched is arranged outside vacuum chamber 120. Superconducting coil 10 is connected to voltmeter 220 via a lead 221 drawn out of vacuum chamber 120. A connector 122 is provided in a position where lead 221 is drawn out of vacuum chamber 120.

In order to suppress conduction of external heat into radiation shield 110, it is preferable that vacuum chamber 120 is not connected to radiation shield 110. In conduction cooling superconducting magnet device 100 according to the present embodiment, however, load support 180, leads 191, 192, 201, and 221 partly lie between vacuum chamber 120 and radiation shield 110, as described above, thus indirectly connecting vacuum chamber 120 to radiation shield 110.

When vacuum chamber 120 is indirectly connected to radiation shield 110, external heat is conducted from vacuum chamber 120 to radiation shield 110 via a member lying between vacuum chamber 120 and radiation shield 110.

In other words, in the present embodiment, load support 180, leads 191, 192, 201, and 221 at least partly lie between vacuum chamber 120 and radiation shield 110, and serve as provided members through which heat is conducted from vacuum chamber 120 to radiation shield 110. The provided members include various members, and the above members are given by way of illustration only.

Conduction cooling superconducting magnet device 100 includes a cooling pipe 160 having opposite end portions drawn out of vacuum chamber 120 and an intermediate portion in contact with superconducting coil 10, radiation shield 110, and the above provided members.

Specifically, an inlet for introducing liquid helium, for example, as a coolant 170 in a direction indicated with an arrow in the figure, and an outlet for discharging coolant 170 are arranged outside vacuum chamber 120. Liquid nitrogen may be used as coolant 170 as well. With liquid helium as coolant 170, members in contact with cooling pipe 160 can be cooled down to 4.2 K by cooling with cooling pipe 160. With liquid nitrogen as coolant 170, members in contact with cooling pipe 160 can be cooled down to 77 K by cooling with cooling pipe 160.

Cooling pipe 160 is arranged to penetrate vacuum chamber 120 and radiation shield 110, and have an intermediate portion in contact with a side end portion of superconducting coil 10. In the present embodiment, cooling pipe 160 is arranged along a coil on an outer circumferential side of superconducting coil 10.

Cooling pipe 160 is also arranged to pass through a position where load support 180 is in contact with radiation shield 110. Further, cooling pipe 160 is arranged such that a portion of cooling pipe 160 branches from the portion in contact with the side end portion of superconducting coil 10, and comes in contact with thermal conduction member 140.

During initial cooling when superconducting coil 10 is cooled from room temperature down to a prescribed temperature, refrigerator 130 is operated, and liquid helium is introduced into cooling pipe 160 as coolant 170. Coolant 170 absorbs heat of superconducting coil 10 while flowing through a portion of cooling pipe 160 which is in contact with superconducting coil 10.

Further, coolant 170 absorbs heat of radiation shield 110 while flowing through a portion of cooling pipe 160 which is in contact with radiation shield 110. By cooling superconducting coil 10 and radiation shield 110 with refrigerator 130 and coolant 170 flowing through cooling pipe 160 in this manner, time required for initial cooling of conduction cooling superconducting magnet device 100 can be reduced as compared to an example where cooling is conducted only with refrigerator 130.

Moreover, in the present invention, coolant 170 absorbs heat of the above provided members while flowing through portions of cooling pipe 160 which are in contact with the provided members. The provided members dissipate heat into coolant 170 flowing through cooling pipe 160, to reduce heat conducted to radiation shield 110.

In the present embodiment, coolant 170 absorbs heat conducted from vacuum chamber 120 to radiation shield 110 via load support 180 while flowing through a portion of cooling pipe 160 which passes through the position where load support 180 is in contact with radiation shield 110.

Figure 2:
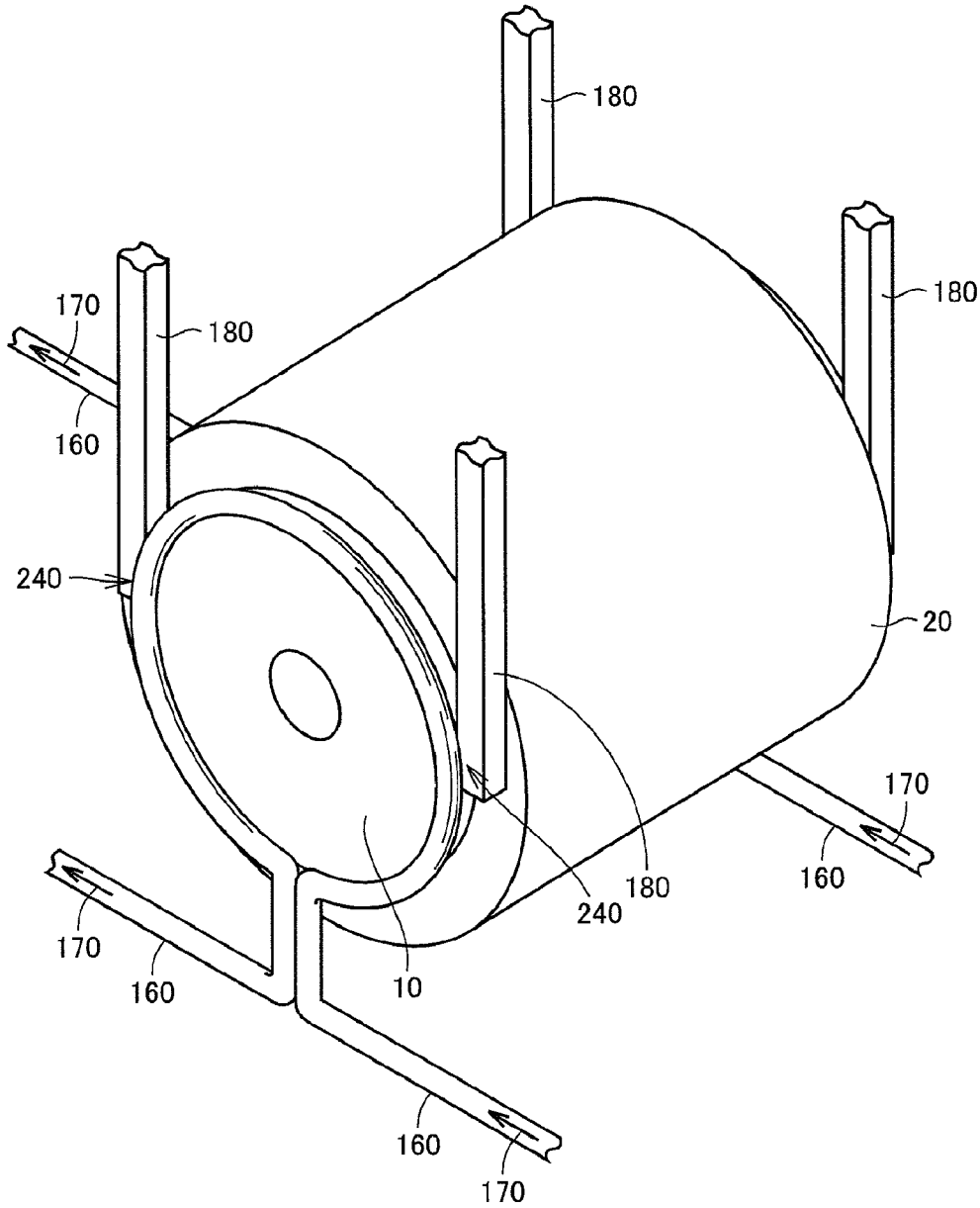
FIG. 2 is a perspective view showing surroundings of a superconducting coil in a radiation shield.

FIG. 2 is a perspective view showing surroundings of the superconducting coil in the radiation shield. As shown in FIG. 2, coil winding frame 20 covers the outer circumference of superconducting coil 10 except a portion in the vicinity of the side end portion of superconducting coil 10, and superconducting coil 10 is supported by load support 180 connected to coil winding frame 20. Cooling pipe 160 is arranged such that a portion of cooling pipe 160 is in contact with a position 240 where coil winding frame 20 is connected to load support 180. In the present embodiment, cooling pipe 160 is arranged to be in contact with side end portions on opposite sides of superconducting coil 10.

With this structure, coolant 170 absorbs heat conducted from load support 180 to coil winding frame 20 while flowing through a portion of cooling pipe 160 which is in contact with position 240 where load support 180 is connected to coil winding frame 20.

Figure 3:
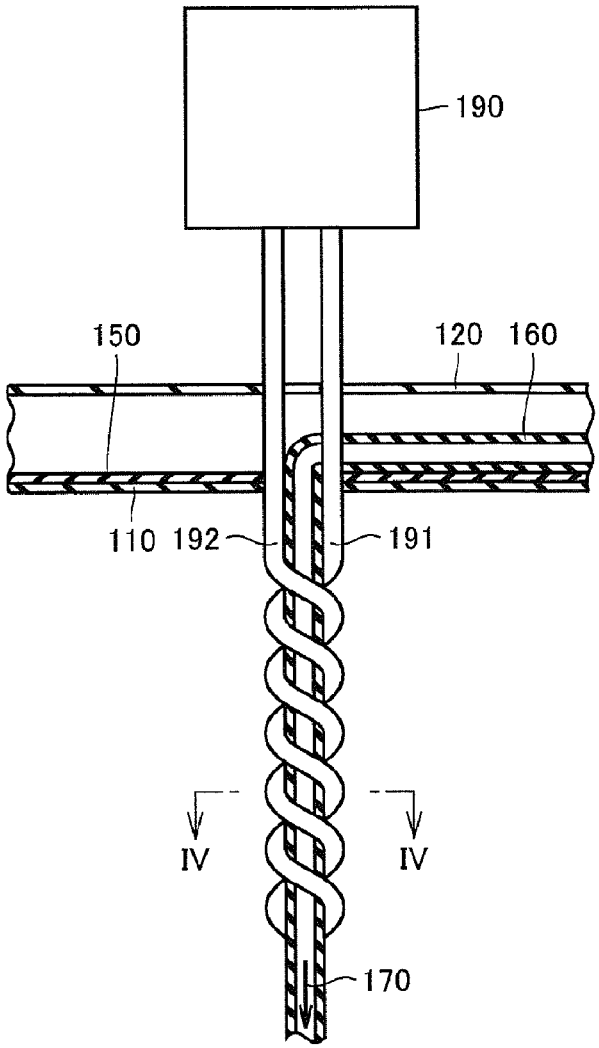
FIG. 3 is a partial cross-sectional view showing arrangement relation between leads connected to a power supply and a cooling pipe.
Figure 4:
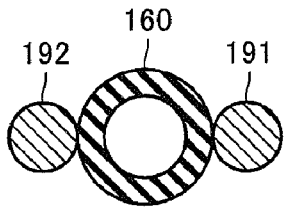
FIG. 4 is a cross-sectional view of the leads and the cooling pipe in FIG. 3 when viewed in a direction of an arrow IV.

FIG. 3 is a partial cross-sectional view showing arrangement relation between the leads connected to the power supply and the cooling pipe. FIG. 4 is a cross-sectional view of the leads and the cooling pipe in FIG. 3 when viewed in a direction of an arrow IV. As shown in FIG. 3, lead 191 and lead 192 connected to power supply 190, which are illustrated only schematically in FIG. 1, are wound around cooling pipe 160.

As shown in FIG. 3, cooling pipe 160 is arranged to pass through positions where lead 191 and lead 192 are in contact with radiation shield 110, respectively. Although lead 191 and lead 192 are covered with insulation, they are arranged opposite to each other with cooling pipe 160 interposed therebetween, as shown in FIG. 4, in order to prevent a short-circuit resulting from contact between them.

With this structure, coolant 170 absorbs heat conducted from vacuum chamber 120 to radiation shield 110 via lead 191 or lead 192 while flowing through portions of cooling pipe 160 which pass through the positions where lead 191 and lead 192 are in contact with radiation shield 110, respectively.

Figure 5:
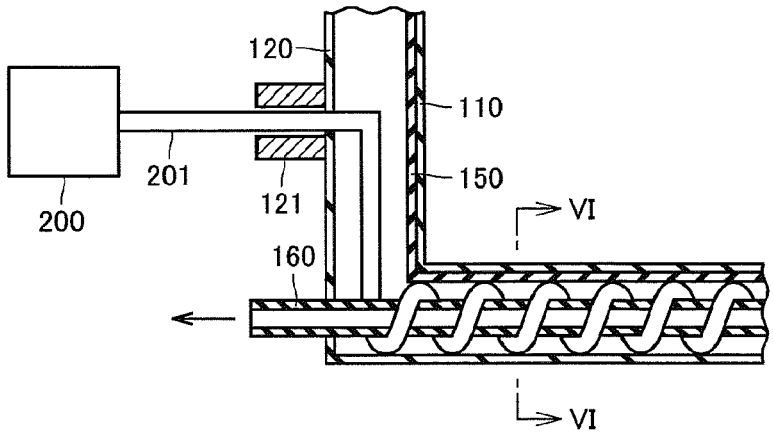
FIG. 5 is a partial cross-sectional view showing arrangement relation between a lead connected to an external display device and the cooling pipe.
Figure 6:
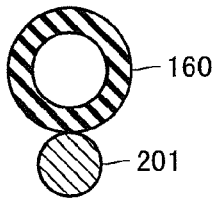
FIG. 6 is a cross-sectional view of the lead and the cooling pipe in FIG. 5 when viewed in a direction of an arrow VI.

FIG. 5 is a partial cross-sectional view showing arrangement relation between the lead connected to the external display device and the cooling pipe. FIG. 6 is a cross-sectional view of the lead and the cooling pipe in FIG. 5 when viewed in a direction of an arrow VI. As shown in FIGS. 5 and 6, lead 201 connected to external display device 200, which is illustrated only schematically in FIG. 1, is wound around cooling pipe 160.

With this structure, coolant 170 absorbs heat conducted from vacuum chamber 120 to radiation shield 110 via lead 201 while flowing through a portion of cooling pipe 160 which has lead 201 wound therearound.

Figure 7:
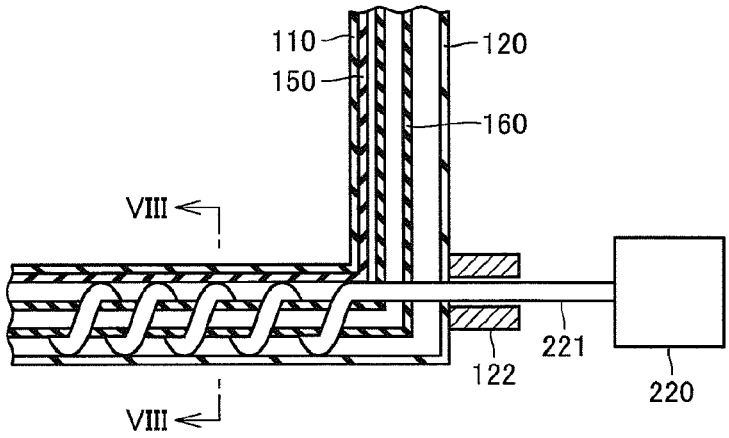
FIG. 7 is a partial cross-sectional view showing arrangement relation between a lead connected to a voltmeter and the cooling pipe.
Figure 8:
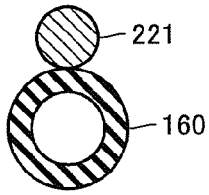
FIG. 8 is a cross-sectional view of the lead and the cooling pipe in FIG. 7 when viewed in a direction of an arrow VIII.

FIG. 7 is a partial cross-sectional view showing arrangement relation between the lead connected to the voltmeter and the cooling pipe. FIG. 8 is a cross-sectional view of the lead and the cooling pipe in FIG. 7 when viewed in a direction of an arrow VIII. As shown in FIGS. 7 and 8, lead 221 connected to voltmeter 220, which is illustrated only schematically in FIG. 1, is wound around cooling pipe 160.

With this structure, coolant 170 absorbs heat conducted from vacuum chamber 120 to radiation shield 110 via lead 221 while flowing through a portion of cooling pipe 160 which has lead 221 wound therearound.

By arranging cooling pipe 160 and flowing coolant 170 through cooling pipe 160 as described above, coolant 170 can absorb heat of the provided members to reduce conduction of heat from vacuum chamber 120 to radiation shield 110 via the provided members. Accordingly, superconducting coil 10 and radiation shield 110 can be cooled in an even shorter time, so that time required for initial cooling of conduction cooling superconducting magnet device 100 can be reduced.

The conduction cooling superconducting magnet device according to a second embodiment of the present invention will be described hereinbelow with reference to the drawings.

Second Embodiment

Figure 9:
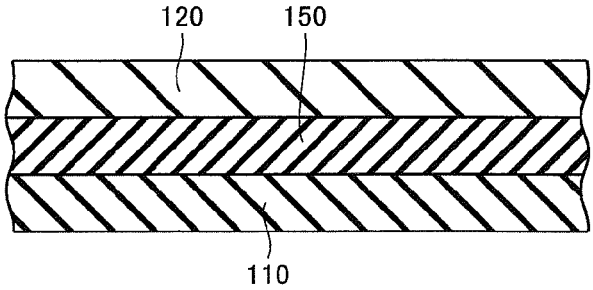
FIG. 9 is a partial cross-sectional view showing a vacuum chamber and a radiation shield being in contact with each other with an SI interposed therebetween.

FIG. 9 is a partial cross-sectional view showing the vacuum chamber and the radiation shield being in contact with each other with the SI interposed therebetween. When space where the conduction cooling superconducting magnet device is to be provided is limited, a clearance may not be ensured between vacuum chamber 120 and SI 150 arranged on radiation shield 110, as shown in FIG. 9. In this case, external heat is conducted from vacuum chamber 120 to radiation shield 110 via SI 150. Accordingly, SI 150 in this case corresponds to the provided member described in the first embodiment.

Figure 10:
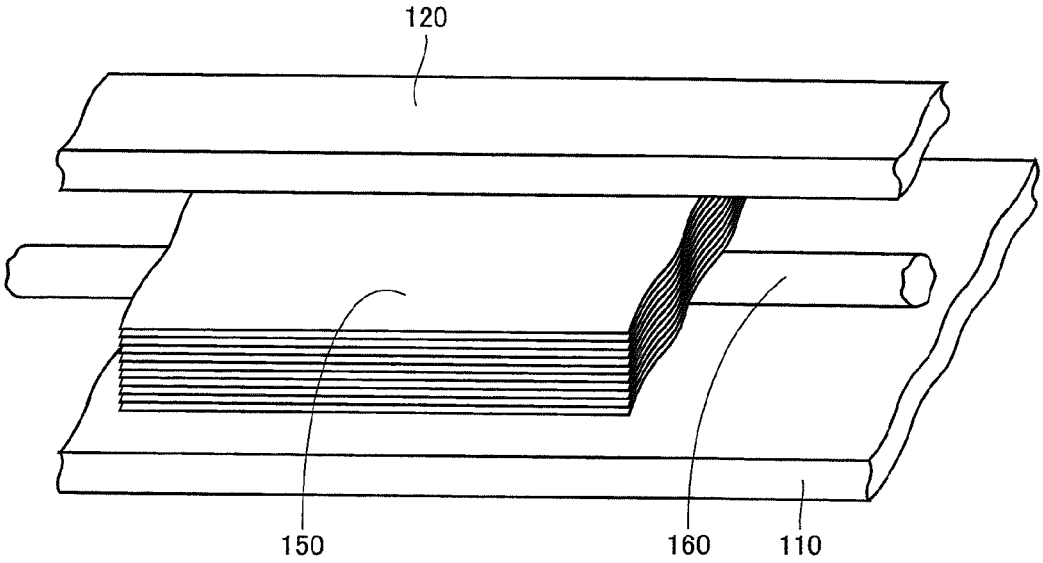
FIG. 10 is a partial cross-sectional view showing a structure of the vacuum chamber, the radiation shield, and the SI according to a second embodiment of the present invention.

FIG. 10 is a partial cross-sectional view showing a structure of the vacuum chamber, the radiation shield, and the SI according to the second embodiment of the present invention. As shown in FIG. 10, in the conduction cooling superconducting magnet device according to the second embodiment of the present invention, cooling pipe 160 is arranged between radiation shield 110 and SI 150, in a portion where vacuum chamber 120 is in contact with SI 150. The number of stacked layers of SI 150 may be reduced to ensure space for cooling pipe 160.

With this structure, coolant 170 flowing through cooling pipe 160 absorbs heat conducted from vacuum chamber 120 to radiation shield 110 via SI 150 while flowing through a portion of cooling pipe 160 which is in contact with SI 150.

As a result, superconducting coil 10 and radiation shield 110 can be cooled in an even shorter time, so that time required for initial cooling of conduction cooling superconducting magnet device 100 can be reduced. The structure is otherwise the same as in the first embodiment, and thus description thereof will not be repeated.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A conduction cooling superconducting magnet device, comprising:

a vacuum chamber;

a superconducting coil accommodated in said vacuum chamber;

a radiation shield arranged in said vacuum chamber with a prescribed space from said vacuum chamber to surround a periphery of said superconducting coil;

a refrigerator for cooling said superconducting coil and said radiation shield by conduction;

a provided member at least partly lying between said vacuum chamber and said radiation shield, through which heat is conducted from said vacuum chamber to said radiation shield; and a cooling pipe having opposite end portions drawn out of said vacuum chamber and an intermediate portion in contact with said superconducting coil, said radiation shield, and said provided member, said provided member dissipating heat into a coolant flowing through said cooling pipe, to reduce the heat conducted to said radiation shield.

2. The conduction cooling superconducting magnet device according to claim 1, wherein said provided member includes a lead drawn out of said vacuum chamber from said superconducting coil.

3. The conduction cooling superconducting magnet device according to claim 1, further comprising:

a temperature measurement unit arranged in said radiation shield; and an external display device arranged outside said vacuum chamber and connected to said temperature measurement unit via a lead, for displaying a measurement result from said temperature measurement unit, wherein said provided member includes said lead.

4. The conduction cooling superconducting magnet device according to claim 1, further comprising:

a lead connected to said superconducting coil, for detecting a voltage applied to said superconducting coil; and a voltage measurement unit arranged outside said vacuum chamber and connected to said lead, wherein said provided member includes said lead.

5. The conduction cooling superconducting magnet device according to claim 1, further comprising a heat insulating material arranged on an outer surface of said radiation shield to cover said radiation shield and being in contact with said vacuum chamber, wherein said provided member includes said heat insulating material.

6. The conduction cooling superconducting magnet device according to claim 2, wherein said lead is wound around said cooling pipe.

7. The conduction cooling superconducting magnet device according to claim 3, wherein said lead is wound around said cooling pipe.

8. The conduction cooling superconducting magnet device according to claim 4, wherein said lead is wound around said cooling pipe.

* * * * *